United States Patent [19]

Ioanesian et al.

[11] Patent Number: 4,475,605

[45] Date of Patent: Oct. 9, 1984

[54] TURBODRILL

[75] Inventors: Jury R. Ioanesian, Moscow; Valery V. Popko, Moskovskaya, both of U.S.S.R.

[73] Assignee: Vsesojuzny Nauchnoissledovatelsky Institut Burovoi Tekhniki, U.S.S.R.

[21] Appl. No.: 301,024

[22] Filed: Sep. 10, 1981

[51] Int. Cl.[3] ..... E21B 4/02

[52] U.S. Cl. ..... 175/107; 175/45; 415/502

[58] Field of Search ..... 175/107, 40, 45, 50, 175/320, 328; 166/65 M, 66; 415/502; 324/346; 33/356, 357; 285/133 A

[56] References Cited

U.S. PATENT DOCUMENTS

| | | | |
|---|---|---|---|
| 2,348,047 | 5/1944 | Yost | 175/107 X |
| 2,850,264 | 9/1958 | Grable | 285/133 A |
| 2,890,859 | 6/1959 | Garrison | 175/107 X |
| 2,908,534 | 10/1959 | Rietsch | 175/107 X |

OTHER PUBLICATIONS

*Van Nostrand's Scientific Encyclopedia*, 5th Edition, Van Nostrand Reinhold Co., New York, 1976, p. 777.

*Primary Examiner*—Ernest R. Purser
*Assistant Examiner*—Michael Starinsky
*Attorney, Agent, or Firm*—Steinberg & Raskin

[57] ABSTRACT

A turbodrill comprising turbine sections, a spindle and a pipe assembly. According to the invention, the pipe assembly is formed by two coaxially arranged pipes provided between the spindle and the adjacent turbine section and coupled to components of the turbodrill.

6 Claims, 4 Drawing Figures

TURBODRILL

TECHNICAL FIELD

The invention relates to the drilling technology, and more particularly to turbodrills.

The invention may be most successfully used in turbodrills designed for drilling deep oil and gas wells under complicated mining and geological conditions.

The invention may also be used in turbodrills designed for directional drilling in applications where the well bore should be drilled with a minimum deviation from a pre-set path of drilling.

BACKGROUND OF THE INVENTION

Efficient performance of drilling operations makes it necessary to determine an actual path of the well bore drilling without pulling the turbodrill and the drilling string to the surface. For that purpose, use is made of a diamagnetic pipe and instruments which are placed in a special diamagnetic container which is housed in the diamagnetic pipe.

The instruments determine the angle of inclination of the container with respect to a vertical line and the direction of this inclination with respect to the magnetic pole of the Earth (azimuth). The diamagnetic pipe is used as a separator of magnetic masses so as to eliminate their influence on the magnetic part of the instrument determining the azimuth.

The three-dimensional position of the well bore is determined in the following manner.

The diamagnetic pipe is installed in the drilling string over or under the turbodrill as close as possible to the drill bit and is aligned with the well axis. The container with the instruments is lowered into the drilling string and is installed in the diamagnetic pipe, the container being centered with respect to the axis of the diamagnetic pipe.

As a result of the relative centering of the container with instruments in the diamagnetic pipe and the diamagnetic pipe in the well bore, the actual path of the well bore (angle of inclination and azimuth) is determined by the instrument readings.

In order that the actual path of the well bore deviate by the minimum possible amount from the pre-set path, the readings of the instrument determining the actual path of the well bore should be obtained at points which are as close as possible to the rock breaking tool (drill bit). These readings are used for the prompt control of the turbodrill operation and drill bit movement without permitting the divergence between the actual and theoretical paths of the well bore to exceed an allowable value.

Two basic requirements to the turbodrill design may be formulated on the basis of the above considerations.

First, the turbodrill should have a diamagnetic pipe which is used to accommodate measuring instruments for determining the path of the well bore drilling, the diamagnetic pipe having to be rigidly coupled to the drilling string and aligned with the well bore.

Second, the design of the turbodrill should provide for a rational accommodation of the diamagnetic pipe used for housing measuring instruments so that the diamagnetic pipe be at the shortest distance from the rock breaking tool such as a drill bit.

One of the turbodrills used at present which is based on a successive system of drilling fluid flow comprises turbine sections each having a casing and a solid shaft.

The turbodrill also comprises a spindle installed in the casing and carrying a rock breaking tool such as a drill bit. The turbodrill has a diamagnetic pipe which is designed to accommodate instruments for measuring the three-dimensional position of the well bore, which is aligned with the path of the well bore and arranged over the turbine sections (cf. M. T. Gusman et al., Calculation, Design and Operation of Turbodrills (in Russian), M., Nedra Publ. House, 1976, p.35, FIG. 9). The provision of the solid shaft and the diamagnetic pipe arranged over the turbine sections in such a turbodrill makes it possible to measure the actual path of the well bore at a distance of 30 to 40 m from the drill bit. This distance from the pipe to the drill bit cannot ensure the prompt control of the bit operation in spite of the fact that the diamagnetic pipe is aligned with the well bore path, since the measurement results are obtained at a distance of 30 to 40 m from the drill bit. The use of such turbodrills becomes inexpedient.

Another turbodrill based on the parallel system of drilling mud flow (cf. USSR Inventor's Certificate No. 121102, 08.12.58) comprises turbine sections each having a casing and a hollow shaft. The turbodrill also comprises a spindle installed in the casing and carrying a rock breaking tool (drill bit). The turbodrill has a diamagnetic pipe which is designed for accommodation of instruments for measuring the three-dimensional position of the well bore, and which is installed under the spindle to transmit axial load and rotary motion to the drill bit. Owing to the fact the turbine section shafts and spindle are hollow, the pipe with the instruments may be installed closer to the drill bit so that measurements of the actual path of the well shaft may be taken at a point closest possible to the drill bit and a prompt control of the turbodrill operation and movement of the drill bit is ensured.

The disadvantage in operation of this turbodrill resides in that, while measurements of the actual path are taken at points as close as possible to the drill bit, they are not accurate enough since the diamagnetic pipe with the instruments is not rigidly coupled to the drilling string and is not aligned with the well shaft because of its use for transmitting rotary motion and axial load to the drill bit.

It does not appear possible to align the diamagnetic pipes accommodating the instruments with the well bore with such an arrangement of the turbodrill, since rotary motion is transmitted to the drill bit at a speed from 2 to 10 revolutions per second which causes a rapid failure of centering members provided on the diamagnetic pipe and spindle, which in turn results in intensive wear of the diamagnetic pipe.

Failure to align the diamagnetic pipe carrying instruments with the well bore results in that the measurements of the three-dimensional position of the bit and turbodrill are not always accurate, and though such measurements are taken at a very close distance from the well bottom the control of the turbodrill operation and movement of the drill bit in space is incorrect. Besides, with this turbodrill it is impossible to drill directional holes, because deflecting devices mounted on the spindle are too far from the bit.

DISCLOSURE OF THE INVENTION

It is the main object of the invention to provide a turbodrill which enables obtaining reliable information on movement of the rock breaking tool in space.

Another object of the invention is to provide a turbodrill which enables the movement of the rock-breaking tool in space with minimum deviations from a pre-set path.

These and other objects are accomplished by that in a turbodrill comprising turbine sections each having a casing and a hollow shaft, and a spindle installed in the casing and carrying a rock breaking tool, the turbodrill having a diamagnetic pipe assembly accommodating instruments for measuring the three-dimensional position of the well bore, according to the invention, the diamagnetic pipe assembly is formed by two coaxially arranged pipes installed between the spindle and the adjacent turbine section, the ends of the other pipe being rigidly coupled to the spindle casing and to the casing of the turbine section and the ends of the inner pipe being coupled to the spindle and hollow shaft of the turbine section for transmitting rotary motion from the hollow shafts of the turbine sections to the spindle.

This design of the diamagnetic pipe assembly, its position in the turbodrill and coupling to the turbodrill components make it possible to obtain most reliable information on the movement of the rock-breaking tool, such as a drill bit, and hence of the turbodrill in space and to promptly control the turbodrill operation and movement of the drill bit with minimum deviations from a pre-set path.

The provision of the diamagnetic pipe assembly in the form of two coaxially arranged pipes makes it possible to separate two functions: transmission of an axial load to the drill bit and transmission of rotary motion to the drill bit, which have been heretofore performed by one and the same pipe, these functions being now performed by two pipes.

The load is transmitted to the drill bit by the outer pipe since it is rigidly coupled to the drilling string and rotary motion is transmitted to the drill bit by the inner pipe. This facility relieves the outer pipe from rotation so as to ensure its more accurate alignment with the well bore. Consequently, readings of the instruments housed in such diamagnetic pipe give more exact indication of the three-dimensional position of a rock breaking tool (drill bit).

The arrangement of the pipes between the spindle and the turbine section adjacent thereto makes it possible to obtain more rational accommodation of instruments for measuring the three-dimensional position in space. Thus only a short spindle is between the measurement point and the drill bit so that the information on the movement of the drill bit in space may be obtained at a short distance from the drill bit and, which is the most important, the position of the drill bit in space may be controlled by means of a short spindle.

In order to obtain required magnetic properties, it is preferable that the pipes are made of a diamagnetic material with a coefficient of magnetic permeability below or equal to 1.12. It is very difficult to ensure desired accuracy with greater values of magnetic permeability.

It is most advantageous from the production point of view that the length of the pipes be determined by the condition $L=30D$ to $60D$, wherein L is the length of the pipes and D is the outside diameter of the turbine section.

The length of the pipes determined by the above condition ensures a desired accuracy of measurement of the three-dimensional position in space owing to the fact that magnetic masses of the turbine sections and spindle do not substantially affect the accuracy since they are separated from the instrument by the diamagnetic pipe assembly over the above-mentioned length.

The rigid coupling of the outer pipe to the turbodrill components may be provided in the form of threaded joints between one end of the pipe and the spindle casing and between the other end of the same pipe and the casing of the turbine section.

This rigid coupling ensures most simple arrangement from the manufacturing point of view.

The coupling of the inner pipe to the turbodrill components may be provided in the form of threaded joints between one of the pipe and the turbodrill spindle and between the other end of the same pipe and the hollow shaft of the turbine section.

The coupling of the inner pipe to the turbodrill components may also comprise tapered splined couplings between one end of the pipe and the turbodrill spindle and between the other end of the same pipe and the hollow shaft of the turbine section.

This coupling makes it possible to obtain an arrangement facilitating assembly and disassembly and ensuring the transmission of rotary motion to the drill bit.

In order to provide for the possibility of flushing and maintenance of permanent cleanliness in the interior of the inner pipe to eliminate its clogging, for exact installation of the instruments, the inner pipe is preferably coupled to the turbodrill components by means of a hydraulic coupling which is formed by the interior space of the turbine section communicating with the interior space of the spindle through the interior space of the inner pipe, and it is preferable to provide hydraulic seals at the end of the inner pipe and at the end of the hollow shaft of the turbine section and the end of the spindle corresponding to these ends.

BRIEF DESCRIPTION OF THE DRAWINGS

The invention will now be described with reference to a specific embodiment illustrated in the accompanying drawings, in which.

DETAILED DESCRIPTION OF THE INVENTION

Figure 1:
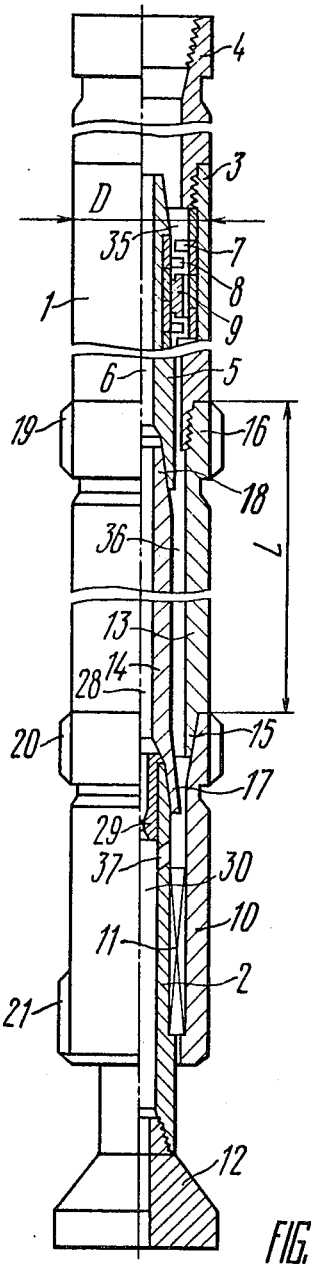
FIG. 1 is a general view of a turbodrill according to the invention, in partial longitudinal section.

A turbodrill shown in FIG. 1 comprises turbine sections 1 and a spindle 2. Each turbine section 1 comprises a casing 3 attached to a drilling string 4 and a hollow shaft 5 having an interior space 6. Turbines of each turbine section 1 are arranged between the casing 3 and the shaft 5 and are formed by stators 7 secured in the casing 3 and rotors 8 installed on the hollow shaft 5. The hollow shaft 5 is aligned with the axis of the casing 3 by means of radial bearings 9 installed in the casing 3.

The spindle 2 is installed in an independent casing 10 by means of a bearing 11 and carries a rock breaking tool in the form of a drill bit 12. The bearing 11 aligns the spindle 2 with respect to the casing 10.

The turbodrill is provided with a diamagnetic pipe assembly in which are housed instruments for measuring the three-dimensional position of the well bore.

According to the invention, the diamagnetic pipe assembly is formed by two coaxially arranged pipes—an outer pipe 13 and an inner pipe 14 which are arranged between the spindle 2 and the turbine section 1 adjacent thereto. An end 15 of the outer pipe 13 is rigidly coupled to the casing 10 of the spindle 2 and an end 16 of the same pipe 13 is coupled to the casing 3 of the turbine section 1. An end 17 of the inner pipe 14 is coupled to the spindle 2 and an end 18 of the same pipe 14 is coupled to the hollow shaft 5 of the turbine section 1.

The rigid coupling of the ends 15 and 16 of the pipe 13 to the casing 10 of the spindle 2 and to the casing 3 of the turbine section 1 enables the transmission of an axial load from the drilling string 4 to the drill bit 12.

The coupling of the ends 17 and 18 of the pipe 14 to the spindle 2 and to the hollow shaft 5 of the turbine section 1 enables the transmission of rotary motion from the hollow shafts 5 of the turbine sections 1 to the spindle 2.

The arrangement of the diamagnetic pipe assembly, its position and coupling to the adjacent components of the turbodrill enables a reliable centering of the outer pipe 13, its rational position in proximity to the drill bit 12 and rigid coupling to the drilling string 4. This becomes possible owing to the fact that the inner pipe 14 transmits rotary motion to the drill bit 12 from the shaft 5 of the turbine section 1.

The pipes 13 and 14 are made of a non-magnetic material with a coefficient of magnetic permeability equal to or below 1.12 so as to ensure desired diamagnetic properties of the pipes. For example, the pipes 13 and 14 may be formed of aluminum or steel having chromium and manganese contents of 18% and 14%, respectively. The length L of the pipes 13 and 14 is determined by the condition L=30D to 60D, wherein D is the outside diameter of the casing 3 of the turbine section 1. This length makes it possible to eliminate the effect of magnetic masses of the turbine section 1 and spindle 2 on the accuracy of measurements for determining the three-dimensional position of the turbodrill in space.

The turbine sections 1 and the spindle 2 with the casing 10 may be of different diameters D depending on the diameter of the employed drill bit 12, hence the magnetic mass thereof may also differ. The length L determined by its values from 30D to 60D covers the range of all practically used diameters of drill bits and turbine sections.

In order to align the outer pipe 13 in the well bore (not shown in the drawings), ribs 19 and 20 are provided which are made in the form of spirals embracing the pipe 13 over its periphery, the outside diameter of the spirals being substantially equal to the outside diameter of the drill bit 12. These ribs effectively align the pipe 13 with the well bore since they do not rotate, hence their wear rate is very small.

A similar rib 21 is provided on the casing 10 of the spindle 2 and has and outside diameter which is substantially equal to the outside diameter of the drill bit 12 (this diameter may be greater than the outside diameter of the drill bit 12).

Figure 4:
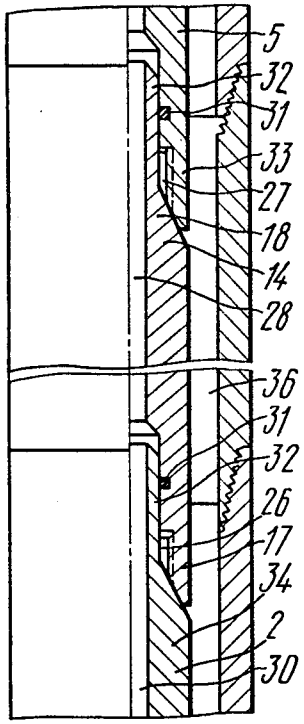
FIG. 4 shows a tapered splined coupling of the ends of an inner diamagnetic pipe to components of a turbodrill according to the invention.
Figure 3:
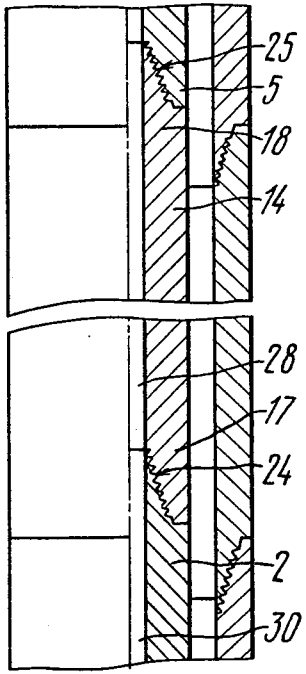
FIG. 3 shows a threaded joint between the ends of an inner diamagnetic pipe and components of a turbodrill according to the invention.
Figure 2:
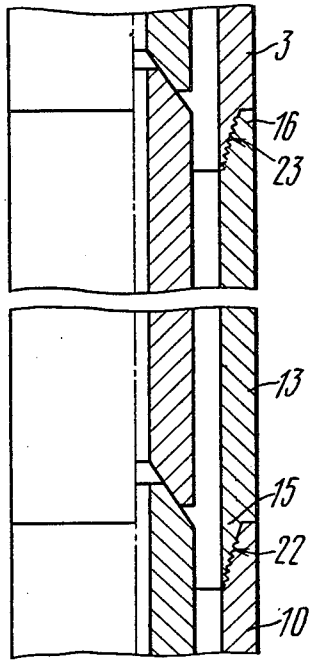
FIG. 2 shows a threaded joint between the ends of an outer diamagnetic pipe and components of a turbodrill according to the invention.

This rib is designed for controlling the movement of the drill bit in space by acting on the drill bit 12 through the casing 10, bearing 11 and spindle 2. The end 15 of the outer pipe 13 and the casing 10 of the spindle 2 are coupled by means of a threaded joint 22 (FIG. 2), and the other end 16 of the same pipe 13 is coupled to the casing 3 of the turbine section 1 by means of a threaded joint 23. These threaded couplings provide for a rigid connection and transmission of load to the drill bit 12. The end 17 of the inner pipe 14 is coupled to the spindle 2 of the turbodrill by means of a threaded joint 24 (FIG. 3), and the end 18 of the inner pipe 14 is coupled to the hollow shaft 5 of the turbine section 1 by means of a threaded joint 25. These threaded joints enable the transmission of rotary motion to the drill bit 12 and simplify the design of the turbodrill. FIG. 4 shows another embodiment of the coupling of the inner pipe 14 to the components of the turbodrill, wherein the end 17 of the inner pipe 14 is coupled to the spindle 2 of the turbodrill by means of a tapered splined coupling 26, and the end 18 of the same pipe 14 is coupled to the hollow shaft 5 of the turbine section 1 by means of a tapered splined coupling 27.

This coupling enables the transmission of rotary motion to the drill bit without slippage and also accelerates the assembly and disassembly operations with the turbodrill.

In case an abrasive drilling fluid is used, the interior spaces 6 of the shafts 5 and the interior space 28 of the pipe 14 are flushed with the fraction of the abrasive fluid admitted to the turbodrill from the drilling string 4.

For that purpose, a flow nipple 29 (FIG. 1) is provided at the end 17 of the pipe 14 for controlling the flow of drilling fluid through the turbine sections 1. In order to reduce working pressure over the flow nipple 29, several flow nipples 29 may be provided having a greater inside diameter. This improves the reliability of turbodrill in operation and eliminates clogging of the nipple 29.

A hydraulic coupling of the drilling string 4 to the drill bit 12 comprises the interior space 6 of the shaft 5 of the turbine section 1, the interior space 28 of the inner pipe 14 and the interior space 30 (FIG. 4) of the spindle 2. To avoid leakage of drilling fluid from the interior space 28 of the inner pipe 14, there is provided a hydraulic seal 31 at the end 17 of the inner pipe 14 and at the end 33 of the hollow shaft 5, and also a hydraulic seal 32 at the end 34 of the spindle 2 and at the end 18 of the inner pipe 14.

To supply the main flow of drilling fluid to the drill bit 12, the drill bit is hydraulically coupled to the drilling string 4 through interior spaces 35 of the turbine sections 1, an interior space 36 of the outer pipe 13 and a port 37 in the periphery of the spindle 2 above the flow nipple 29, and the interior space 30 of the spindle 2.

DESCRIPTION OF OPERATION

Before lowering in the well bore, the turbodrill is assembled. The drill bit 12 is installed under the spindle 2. The pipe 13 is installed on the casing 10 of the spindle 2 with its end 15 by means of the threaded joint 22. The pipe 14 is then lowered into the pipe 13, the end 17 of the pipe 14 being coupled to the spindle 2. Subsequently the casing 3 of the turbine section 1 is coupled to the end 16 of the pipe 13 by means of the threaded joint 23, the shaft 5 being coupled with its end 33 to the end 18 of the inner pipe 14.

The weight of the shaft 5 and pipe 14 is taken up by the bearing 11 through the spindle 2.

This method for assembling the components of the turbodrill is the most simple and convenient and enables the performance of various functions by these components.

Another method of assembly may also be used, wherein the inner pipe 14 is coupled to the components of the turbodrill by means of threaded joints 24 and 25. This method takes somewhat more time compared to the first one, but it ensures the sealing of the interior space 28, the importance of which will be explained below.

The most convenient and preferable method of assembling the inner pipe 14 resides in coupling its ends 17 and 18 by means of tapered splined couplings 26 and 27 to the hollow shaft 5 and spindle 2, respectively.

The interior space 28 is thus reliably sealed off by means of the seals 31 and 32 with respect to the adjacent interior space 36.

The turbodrill is now assembled as described above and functions in the well bore in the following manner.

Drilling fluid is supplied to the turbine section 1 through the drilling string 4 and is divided in the turbine section 1 into two flows.

The main flow of drilling fluid is admitted, through the interior space 35 of the turbine section 1, to the stators 7 and rotors 8.

After passing through all stators 7 and rotors 8 the main flow of drilling fluid is admitted to the drill bit 12 through the interior space 36 of the outer pipe 13, and the port 37 of the spindle 2.

The other flow of drilling fluid is admitted to the interior space 6 of the hollow shaft 5 of the turbine section 1 and to the interior space 30 of the spindle 2, through the interior space 28 of the inner pipe 14 and flow nipple 29, this flow merging with the main flow of drilling fluid in the interior of the spindle 2 and to be admitted to the drill bit 12.

In order to avoid clogging of the interior space 28 of the pipe 14, it is continuously flushed during operation. The flushing is ensured by virtue of sealing of the interior space 28 by means of the hydraulic restrictors 31 and 32 so that no dead zones are formed in the interior space 28.

The rotors 8 drive the hollow shaft 5 which rotates in radial bearings 9 of the casing 3. Rotary motion is transmitted from the hollow shaft 5 through the inner pipe 14 and spindle 2 to the drill bit 12. Load from the drilling string 4 is transmitted to the drill bit 12 through the casing 3 of the turbine section 1, outer pipe 13, spindle casing 10, thrust bearing 11 and spindle 2.

Rotary motion is transmitted from the hollow shaft 5 to the pipe 14 through the end 18 thereof, and rotary motion is transmitted from the pipe to the spindle 2 through the end 17 of the pipe 14.

The outer pipe 13 transmits the load from the casing 3 of the turbine section 1 to the casing 10 of the spindle 2 through its ends 15 and 16.

Since the pipes 13 and 14 are made of a diamagnetic material, instruments (not shown) installed therein may determine (measure) the three-dimensional position of the turbodrill and drill bit in space.

For making such measurement, the supply of drilling fluid to the turbodrill is temporarily cut off and, without pulling the turbodrill to the surface, instruments for measuring the three-dimensional position of the drill bit in space are lowered on a wire rope through the drilling string 4.

The instruments get from the string 4 through the hollow shaft 5 into the pipe 14 where the measurements are taken.

The instruments are then pulled out and the supply of drilling fluid starts anew.

Such measurements may be taken as frequently as necessary.

The instrument readings are used to determine the need to correct the drill bit movement and the operation of the turbodrill, as well as the position of the rib 21 with respect to the magnetic pole of the Earth.

This arrangement of the turbodrill makes it possible to drill directional holes under complicated mining and geological conditions so as to bring the drill bit to a predetermined "target". In addition, the use of the turbodrill is advantageous in drilling straight holes under conditions causing a spontaneous deviation of the well bore.

We claim:

1. A turbodrill comprising:

at least one turbine section having a casing and a hollow shaft;

a spindle installed in an independent casing and carrying a rock breaking tool;

a pipe assembly accommodating instruments for measuring the three-dimensional position of a well bore in space, the pipe assembly being formed by two coaxially arranged pipes provided between said spindle and said turbine section adjacent thereto;

one end of the outer pipe being rigidly coupled to the casing of said spindle, the other end of the outer pipe being rigidly coupled to the casing of the turbine section;

one end of the inner pipe being coupled to said spindle, the other end of the inner pipe being coupled to the hollow shaft of said turbine section so as to transmit rotary motion from said shaft to said spindle;

wherein the pipes are made of material with a coefficient of magnetic permeability not greater than about 1.12; and said turbodrill is adapted to ensure accurate alignment of said outer pipe with the well bore and adapted to ensure accurate readings of said measuring instruments accommodated in said pipe assembly, thus ensuring accurate three-dimensional position measuring of said rock breaking tool.

2. A turbodrill according to claim 1, wherein the length L of the pipes is in the range of between about 30D and 60D, wherein D is the outside diameter of the casing of the turbine section.

3. A turbodrill according to claim 1, wherein the rigid coupling of the outer pipe to components of the turbodrill comprises threaded joints formed between said one end of the pipe and the spindle casing and between said other end of the outer pipe and the casing of the turbine section.

4. A turbodrill according to claim 1, wherein the coupling of the inner pipe to components of the turbodrill comprises threaded joints formed between said one end of the pipe and the spindle and between said other end of the inner pipe and the hollow shaft of the turbine section.

5. A turbodrill according to claim 1, wherein the coupling of the inner pipe to components of the turbodrill comprises tapered splined couplings formed between said one end of the inner pipe and the spindle and between said other end of the inner pipe and the hollow shaft of the turbine section.

6. A turbodrill according to claim 1, wherein the inner pipe is coupled to components of the turbodrill by means of a hydraulic coupling which is formed by an interior space of the shaft of the turbine section communicating with an interior space of the spindle through an interior space of the inner pipe, the ends of the innner pipe and respective ends of the hollow shaft of the turbine section and of the spindle being provided with hydraulic seals, and at least one flow nipple being provided between the ends of the inner pipe and the end of the spindle for controlling the flow of drilling fluid through the turbine sections.

* * * * *